United States Patent [19]

Simpson

[11] Patent Number: 4,553,353

[45] Date of Patent: Nov. 19, 1985

[54] LATCH FOR PIVOTAL SASH WINDOW

[75] Inventor: Harold Simpson, Chicago, Ill.

[73] Assignee: Ashland Products Company, Chicago, Ill.

[21] Appl. No.: 602,386

[22] Filed: Apr. 20, 1984

[51] Int. Cl.[4] ..... E05D 15/22

[52] U.S. Cl. ..... 49/161; 49/175; 49/449

[58] Field of Search ..... 49/161, 175, 181, 174, 49/176, 450, 451, 449

[56] References Cited

U.S. PATENT DOCUMENTS

| | | | |
|---|---|---|---|
| 3,099,050 | 7/1963 | Hetman | 49/450 X |
| 3,153,264 | 10/1964 | Lemme | 49/451 |
| 3,959,926 | 6/1976 | Noecker et al. | 49/181 |
| 4,144,674 | 3/1979 | Dovman | 49/181 X |
| 4,222,201 | 9/1980 | Yanessa | 49/174 X |
| 4,263,760 | 4/1981 | Gell | 49/450 X |
| 4,475,311 | 10/1984 | Gibson | 49/176 |

*Primary Examiner*—Philip C. Kannan

*Attorney, Agent, or Firm*—Silverman, Cass & Singer, Ltd.

[57] ABSTRACT

A latch for a pivotal window sash used in a double-hung window assembly. The latch is mounted internally in a sash frame member with its latch bolt protruding from the sash to engage in the guide rail of the master frame jamb of the window assembly. There is a finger manipulative control button external of the sash frame for releasing the bolt from said guide rail so that the window sash can be pivoted. The latch bolt is mounted under spring tension to maintain the bolt normally in a locked position.

7 Claims, 4 Drawing Figures

LATCH FOR PIVOTAL SASH WINDOW

RELATED CASE REFERENCE

This application is related in the subject matter of the latch to applicant's co-pending patent application entitled CORNER LOCKING AND ASSOCIATED PIVOT MEANS FOR EXTRUDED PLASTIC SASH WINDOWS filed Apr. 20, 1984, Ser. No. 06/602,382 and owned by the same assignee.

BACKGROUND OF THE INVENTION

This invention relates generally to a manually operative latch for a window sash of a double-hung window assembly and more particularly, to a novel latch capable of being installed internally in the sash window frame and which is releasable from externally of the window frame. Further, this latch is particularly suitable for a pivotal sash window.

A double-hung window assembly includes a window frame and a pair of window sashes reciprocal vertically in guide rails of the master frame jamb of the window assembly. Such a window sash also can be pivotally mounted in the window frame. Normal vertical movement of the window sash is maintained by latch mechanisms located at opposed corners of the window sash. Such a latch mechanism will include a latch bolt which can slide along the guide rails but which, while engaged in the guide rails, prevent pivoting of the window sash. The window sash is pivotal when the latch bolt is retracted from the guide rail by means of suitably installed pivot pins usually engaging sash balance mechanisms of the assembly.

Such pivotal window sash can be formed either of extruded plastic frame members or metal frame members joined at mitered corners to form a generally rectangular frame in which the glazing is mounted. In my co-pending patent application, a novel corner supporting and connecting member is described and illustrated which functions to establish and maintain the corner miter joint of a synthetic plastic sash frame. Said novel member also serves to mount a latch mechanism for a pivotal window sash. A notable feature of that latch mechanism is its internal mounting with a manual manipulative control button exterior of the sash frame.

The latch mechanism of the invention herein can be mounted internally of a pivotal window sash formed of either synthetic plastic or metal sash frame members. Yet, it is hidden from view other than for the exposed control button for retracting the latch bolt thereof from a guide rail so that the sash can be pivoted. The corner miter joint is established and maintained by right angle brackets or corner support means other than disclosed in my copending patent application.

The latch of the invention is economical to manufacture and easy to install and operate. Also, it is sturdy and capable of extended use without failure.

U.S. Pat No. 4,144,674 has a latch mechanism mounted externally of the window sash which is of interest.

SUMMARY OF THE INVENTION

The invention comprises a latch mechanism for the pivotal window sash for a double-hung window assembly. Each sash comprises a rectangular frame formed by a top header, two sides stiles and a bottom base. The sash frame mounts suitable glazing. The header, stiles and base are joined at contiguous miter joints. The stiles have outer side walls through each of which is provided a passageway opening outwardly of the sash frame.

The latch mechanism is mounted internally of the header port and includes a spring mounted latch bolt having a tapered extremity protruding through a said passageway to engage the guide rail of the master frame jamb of the window assembly. The latch bolt is linearly movable for retracting from the guide rail by means of a manually manipulative control member exterior of the header. The latch bolt normally is sping biased to a locking position engaged in the guide rail.

The operating parts of the latch are formed of molded plastic materials, with the exception of the spring utilized.

DESCRIPTION OF PREFERRED EMBODIMENT

Figure 1:
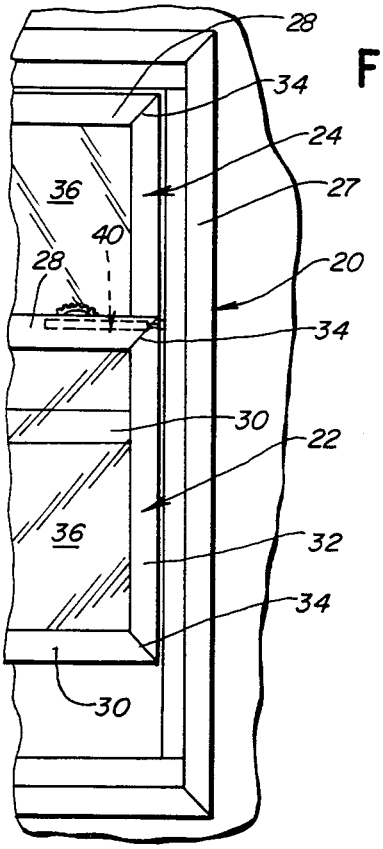
FIG. 1 is a fragmentary front elevational view of a double-hung window assembly having the latch mechanism embodying the invention installed on a window sash of the assembly.

FIG. 1 illustrates partially a representative window of the so-called double-hung window sash assembly. Such an assembly includes a main jamb frame 20 within which is slidably mounted a pair of double hung sashes 22 and 24 fitted with suitable glazing. Both the frame 20 and sashes 22 and 24 can be formed of several different materials, such as metal or strong and rigid plastic materials well known in this field. For purposes of this invention, the sashes 24 and 22 are pivotal relative to the frame 20 to permit cleaning and other required maintenance thereof.

The master frame 20 and the sashes 22 and 24 preferably are fabricated from elongate framing members of hollow configuration in transverse cross-section for well known reasons of weight economy and thermal insulation advantages. The exact construction of master frame 20 is not critical for achieving the advantages of this invention. The vertical structural members of the master frame 20 will mount sash balances (not shown) which will cooperate with pivot pins (not shown) installed on the sashes 22 and 24 to permit desired pivotal movement of the sashes relative to the master frame. Further, these vertical structural members of the frame 20 will present guide rails facing toward a contiguous sash with which the latch mechanism embodying the invention operates. A typical guide rail is designated 26 in FIG. 2 for the purpose of describing this invention. The guide rail 26 would be formed in a side jamb 27 of the matter jamb frame.

Figure 2:
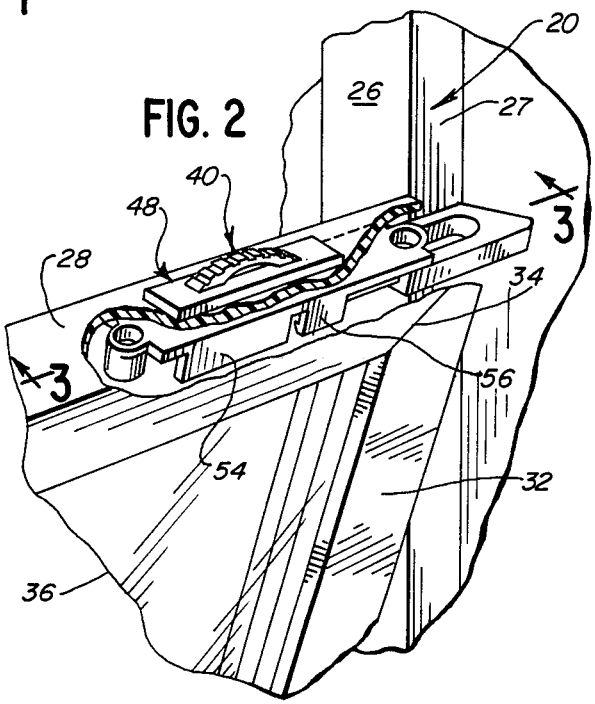
FIG. 2 is a fragmentary perspective view of a window sash in a pivoted open position and broken away to show details of said latch mechanism.

Referring to FIGS. 1 and 2, a sash 22 is generally rectilinear in configuration and is comprised of a top header 28, a base 30 and a pair of side members or stiles, one of which is illustrated at 32. The stiles or side members 32 are miter-jointed at their extremities to contiguous extremities of the header and base members, as seen at 34, to provide the sash frame of desired size and configuration. The miter-jointed corners of the sash are maintained by suitable fasteners and brackets of well-known, commerically available types. It will be appreciated that the upper sash 24 will be of like or similar construction. The glazing 36 is conventionally installed in a sash frame.

Figure 4:
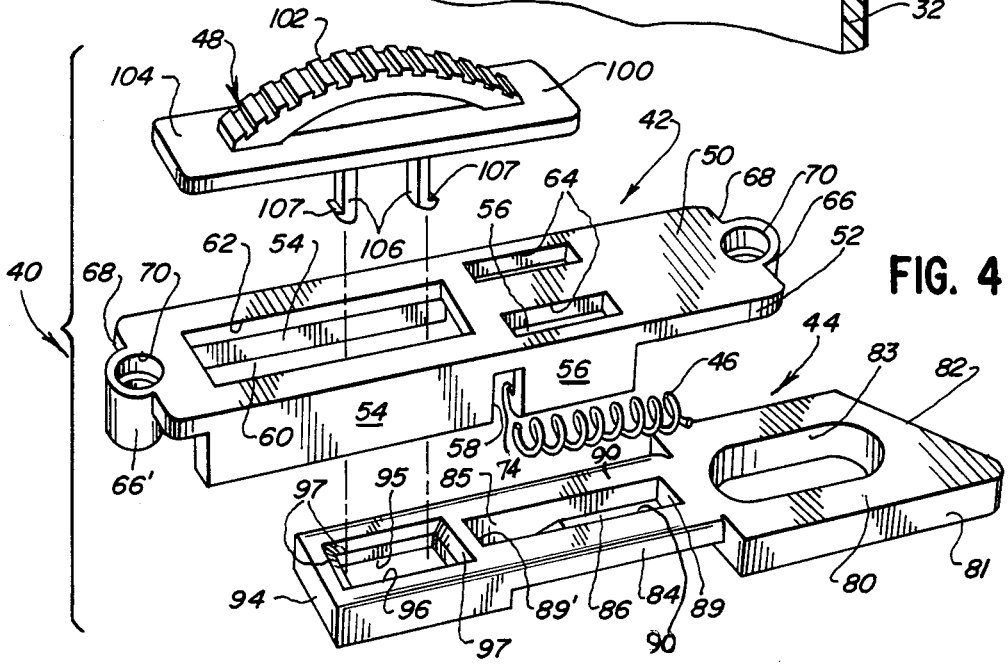
FIG. 4 is an exploded perspective view of the latch assembly embodying the invention.

The latch mechanism embodying the invention is designated generally by reference character 40. The component parts of latch 40 are seen in FIG. 4 to include a housing 42, a latch bolt 44, a coil spring 46 and a control member or finger button 48. The housing 42, bolt 44 and button 48 are plastic molded members of suitably strong synthetic resin material, such as polystyrene, for instance. The mechanism 40 is seen installed internally in sash 22 in FIG. 2 with only the control member 48 exposed for manually operating the latch mechanism.

Housing 42 has a flat upper surface 50 provided on the plate-like formation 52 which extends the full length of the housing. Depending along opposite longitudinal edges of the plate formation 52 is a pair of side walls 54 and a pair of side walls 56 separated by the space 58. The side walls 54 and 56 define a chamber 60 therebetween opening downwardly from plate or wall 52 along the length of the housing. The top wall or plate 52 has an elongated, rectangular slot 62 opening downwardly from surface 50 into chamber 60 between side walls 54. Also, there is a pair of laterally spaced, shorter slots 64 opening from surface 50 into the chamber space 60 between walls 56. The plate or top wall 52 has a pair of cylindrical bosses 66,66', one at each end 68 thereof. Each boss 66 has a countersunk bore 70 entirely therethrough with each boss extending below the plate 52 as seen at 72 in FIG. 3. It will be noted that slot 62 is spaced longitudinally along plate or wall 56 from the slots 64. Further, the side walls 56 each has an inwardly extending flange 74 at its lower extremity so that the flanges 74 are facing toward each other to provide a ledge for a purpose to be explained hereinafter. A post 75 depends from top wall 52 adjacent the slot 62 and between walls 54. Also, a rectangular depression 76 is formed in the underside of plate 52 between side walls 56 and abutting post 75 at one end of the depression 76.

The latch bolt 44 is an integral, plate-like or planar member with particular formations provided from end-to-end thereof for achieving specific functions. The entire upper surface 80 of bolt 44 is planar, smooth and uninterrupted except for certain through-slots opening from the surface 80.

There is an enlarged end 81 provided with an outer free extremity 82 which is canted or angled. End 81 has an ovate slot 83 therethrough.

Extending inwardly from end 81 is an elongate, medial body segment 84 which is narrower than end 81. Segment 84 has an elongated rectangular chamber 85 opening to top surface 80 and partially closed at its bottom end by the shortened wall 86 tapered at its end 87. Thus, chamber 85 has a shortened opening 88 (FIG. 2) in its bottom end. The opposing end walls 89, 89' of the chamber 85 are vertically oriented and parallel.

The opposite end 94 of the bolt 44 has a rectangular slot 95 entirely therethrough. At its open end 96 into surface 80, the peripheral walls thereof are chamfered, as seen at 97 in FIG. 4. The peripheral walls are undercut, as seen at 98, in FIG. 3.

Figure 3:
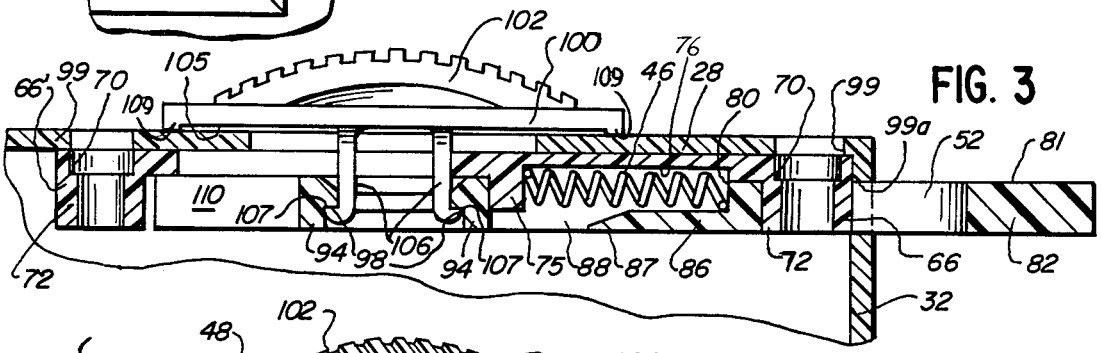
FIG. 3 is a fragmentary sectional view taken along the line 3—3 of FIG. 2 and in the direction indicated generally.

Referring to FIGS. 2 and 3 for installation and operation of the latch mechanism 40. The coil spring 46, of suitable wire and dimension, is installed in chamber 85 resting on wall 86 and in compressed condition. One end of the coil spring 46 abuts wall 89, as seein in FIG. 3. The other end of the coil spring will abut the depending post 75 of the housing 42 when the bolt 44 is assembled thereto.

Bolt 44 is assembled to housing 42 by snap fitting medial body segment 84 past the walls 56 which are sufficiently flexible for this purpose. The flanges 74 will engage against the undercuts 92 of the side walls 90 to retain the bolt installed. The flat, smooth surface 80 will be contiguous the undersurface of plate formation 50. The cylindrical boss formation 66 is received in the ovate slot 83 and the cylindrical boss 66' is positioned externally of the slot 95. The end 96, which is of the same width as the medial body segment 84, is received loosely between the side walls 54. Likewise, the medial segment 84 is loosely received between side walls 56 so that the bolt 44 can be slid relative the housing 42. The depending post 75 is received in the opening 88 in bottom end of chamber 85 so that an end of spring 46 can abut it, as seen in FIG. 3. Thus installed, the end 81 of the bolt 44 will be seen to be wider than the medial segment 84 and end part 94 and approximately equal in width to the plate formation 52. Both the undersurface of plate 52 and the contiguous upper surface 80 of bolt 44 are very smooth so as to reduce friction therebetween when the bolt 44 is slid relative to the housing 42 in operation of mechanism 40. Also, the end 81 protrudes outwardly of end 52 of the housing 42 in assembly mode.

The assembled housing 42 and bolt 44 are installed internally of sash 22 at each upper, miter-jointed corner thereof. The header 28 will have a pair of openings 99 spaced apart to align with the bores 70 of bosses 66 and 66' at an upper corner of the sash 22, as seen in FIG. 3. Suitable threaded fasteners, not shown, will be engaged in the aligned openings and bores to secure housing 42 against the undersurface 91 of the header 28. The end 81 of bolt 44 will be extended through an aligned opening **99*a* in the side member or stile 32 so that the canted edge 82 can be engaged with the guide rail 26 of the side frame jamb 27. Thus, the assembled housing and latch bolt are installed internally in the sash 22**, one at each upper corner thereof.

The control member or button 48 is an integral member having a plate part 100 carrying a finger button formation 102 on its upper surface 104. The formation 102 can assume any one of many different configurations so long as it provides an enlarged finger grip as represented at 102. Depending from the bottom surface 105 is a pair of spaced apart posts 106. Each post has a flange 107 at its free end extending outwardly from the flange. The posts 106 are spaced apart a selected distance so that they have to be snap-fitted into the slot 95 by compressing the posts slightly to enable the flanges 107 to extend beyond the walls 97 and engage the undercuts 98, as seen in FIG. 3. Of course, it will be understood that the header 28 will be provided with a suitable slot to align with slot 95 for accommodating the posts 106 therethrough. Further, the length of the posts 106 is selected to accommodate the added thickness of the header 28 and thereby permit engaging the flanges 107 against the undercuts 98 when the control member 48 is to be installed. The underside 105 of the plate 100 may have small post-like protruberances 109 (FIG. 3) for facilitating sliding movement on the header 28.

In the normal installed position of the latch mechanism, the sash 22 will be closed. Spring 46 is mounted in a compressed condition under tension so as to urge bolt 44 into engagement with the guide rail 26 and prevent pivoting of the window. To open the latch 40, the finger button 102 is moved in a direction away from the guide rail 26. The posts 106 engaged with opposing side walls 97 will move the latch bolt 42 to retract the end 81 and withdraw the angled edge 82 from the guide rail sufficiently so that window sash 22 can be pivoted open, as seen in FIG. 2. Of course, the latch mechanism 40 at each upper corner of the sash 22 must be so manipulated to open sash 22. Upon release of the button 102, the latch bolt will be urged outwardly to its normal protruding position depicted in FIGS. 2 and 3.

As seen in FIG. 3, there is clearance space 110 for lateral movement of the engaged posts 106 and end part 94 to the left for retracting the end 81 of the latch bolt.

It is believed unnecessary to describe installation of the latch mechanism 40 embodying the invention in the upper sash 24 in view of the reference to the related application. The latch mechanisms 40 will be installed in the header of the upper sash at the corners, as will be understood from said related application and will function as described for its installation in sash 22.

Modifications and variations of the present invention thus are possible in light of the above teachings. It is therefore to be understood that within the scope of the appended claims, the invention may be practiced otherwise than as specifically described.

I claim:

1. In a pivotal-type window sash adapted for installation in the master jamb frame of a double-hung window assembly having opposed, vertically extending guide rails to enable vertical reciprocal sliding movement of the sash in the master jamb frame while cooperatively engaged with the guide rails, the sash having a header, a base and a pair of stiles cooperatively connected together at adjacent extremities thereof to form a miter-jointed, rectangular sash frame; a latch mechanism adapted to be operatively installed internally of the sash frame to said header, albeit manually operable from externally of the sash frame for releasing the latch mechanism to permit pivotal movement of the window sash, said latch mechanism comprising:

A. a housing having a planar upper wall, a depending boss formation at opposite ends of said wall having a bore therein opening to the upper surface of said planar wall, and opposing said wall formations depending from said planar wall along opposite longitudinal edges of the planar wall, a pair of said side wall formations having flange formations at the extremities thereof;

B. a latching bolt slidably installed in said housing between said side wall formation supported on said flange formations below said planar wall, said bolt having an end segment protruding beyond an end of said housing for engaging in a guide rail for releasably locking the said frame against pivotal movement relative to the master jamb frame, the bolt being installed under spring tension normally urging said end segment into locking position relative to a guide rail;

C. a control member having depending post means connected through said planar wall to said latch bolt for manually sliding the bolt against said spring tension for retracting said end segment from a guide rail;

D. said housing adapted to be secured to an interior surface of said header by fastener means extending through the header into said bores of the boss formations and said end segment of the latch bolt extending through a passageway in a stile into operative engagement with a guide rail;

E. said control member adapted to be connected to the latch bolt externally of the header by means of said post means extending through the header, the control member being slidable on the header for releasing the latch bolt.

2. The latch mechanism of claim 1 in which said housing, latch bolt and control member are molded from a strong, synthetic plastic material.

3. The latch mechanism of claim 1 in which the control member has a planar wall part having a flat, smooth surface contiguous the header for facilitating sliding movement of the member relative to the header and an upstanding formation on its opposite surface for manipulating said control member.

4. The latch mechanism of a claim 3 in which said housing has a slot therethrough having undercut edges, said post means extending through said slot into engagement with said undercut edges for connecting the control member to said latch bolt.

5. The latch mechanism of claim 1 in which said planar upper wall of the housing has a flat, smooth bottom surface contiguous the latch bolt, said latch bolt having a flat, smooth surface contiguous said bottom surface of the housing for facilitating sliding movement of the latch bolt relative to the housing.

6. The latch mechanism of claim 1 in which said end segment of the bolt has an angled extremity presented to the guide rail.

7. The latch mechanism of claim 1 in which said spring tension is provided by means of a coil spring mounted in the housing between a pair of said side wall formations.

* * * * *